United States Patent [19]

Del Fabro et al.

[11] Patent Number: 4,989,429

[45] Date of Patent: Feb. 5, 1991

[54] ROCKER BENDING UNIT

[75] Inventors: Marcello Del Fabro, Udine; Giorgio Del Fabro, Cassacco-Fraz.Montegnacco, both of Italy

[73] Assignee: M.E.P. Macchine Elettroniche Piegatrici SpA, Reana Del Rojale, Italy

[21] Appl. No.: 463,445

[22] Filed: Jan. 11, 1990

[30] Foreign Application Priority Data

Jan. 18, 1989 [IT] Italy ..... 15902 A/89

[51] Int. Cl.[5] ..... B21D 7/022

[52] U.S. Cl. ..... 72/307; 72/388; 72/217

[58] Field of Search ..... 72/307, 386–388, 72/214–219, 149, 159

[56] References Cited

U.S. PATENT DOCUMENTS

| | | | |
|---|---|---|---|
| 183,190 | 10/1876 | McWilliams | 72/218 |
| 328,986 | 10/1885 | Warwick | 72/219 |
| 1,272,552 | 7/1918 | Spencer | 72/217 |
| 3,220,338 | 11/1965 | Norbutas | 72/388 |
| 3,991,600 | 11/1976 | Del Fabro | 72/217 |
| 4,653,301 | 3/1987 | Meliga | 72/174 |

FOREIGN PATENT DOCUMENTS

| | | | |
|---|---|---|---|
| 15354 | 9/1980 | European Pat. Off. . | |
| 3436285 | 4/1985 | Fed. Rep. of Germany . | |
| 2290969 | 6/1976 | France . | |
| 2530980 | 2/1984 | France . | |
| 293445 | 7/1965 | German Democratic Rep. | 72/386 |
| 228959 | 10/1985 | German Democratic Rep. | 72/387 |
| 1011988 | 12/1965 | United Kingdom . | |
| 2169829 | 7/1986 | United Kingdom . | |

*Primary Examiner*—Daniel C. Crane

*Attorney, Agent, or Firm*—Antonelli, Terry, Stout & Kraus

[57] ABSTRACT

Rocker bending unit (10) of a type retractable below a working platform (22) of a bending-shaping machine for bars (29), the unit (10) comprising a bending disk (11) provided with a clockwise and anticlockwise rotation of a bending pin (13) positioned out-of-alignment in relation to the axis of rotation, a contrast roller or pin (12) which may be interchangeable being included and coaxial with the axis of rotation, in which unit (10) the bending disk (11) cooperates with and is supported on a base (18) pivoted so as to be able to rock with a rocker pivot (21) on a frame (28) of the machine downstream of the bending unit (10), the rocking direction lying on a plane substantially at a right angle to the working platform (22) and to the axis of feed of the bars (29), the axis of the rocker pivot (21) being substantially parallel to the working platform (22) and in the geometric neighborhood thereof, the unit (10) being fitted on a slider (27) supported by the base (18) and able to move thereon (18) in a direction substantially at a right angle to the direction of feed of the bars (29).

5 Claims, 4 Drawing Sheets

ROCKER BENDING UNIT

This invention concerns a rocker bending unit; to be more exact, it concerns a bending unit for bending-shaping machines which is able to rock, that is to say, to move on a pivot offset at its periphery, on a vertical plane passing in the neighbourhood of the axis of the bar or bars to be bent or shaped.

The invention is applied correctly to machines that bend bars; this invention is correctly applied advantageously to machines that bend and shape iron bars for building work.

The invention is also employed in all cases where bars are to be bent by means of a bending pin, or an equivalent, able to rotate, out-of-alignment with the axis of rotation, about an axis by a desired angular value clockwise or anticlockwise, the axis of rotation being located in a contrast roller or pin.

By bars we mean here either solid or hollow bars and the term includes those produced by rolling, drawing, extruding or forming.

This invention concerns a bending unit which may be located upstream or downstream of a shears and/or a drawing unit and which serves to bend one or more bars according to the desired geometric configuration, which includes bends with a clockwise or anticlockwise development.

GB No. 1,011,988 discloses a bending unit that comprises a bending pin able to rotate in two directions and cooperating with two stationary cams located astride the axis of rotation of the bending pin. The bending unit can move axially so as to free itself of the constraint created by the bar, where the latter be straight or already shaped.

While such as axial movement is advantageous in the case of stationary contrast cams since the bar does not have to slide on the cams themselves during this axial movement, this axial movement is no longer advantageous in the case of an axial contrast roller fitted to the plate bearing the rotary pin.

In this latter case the removal of the contrast roller from a bar bent even partly about the roller leads to a plurality of problems linked to the fact that the bent bar exerts a necking effect on the contrast roller.

Owing to this situation the contrast roller during the descent step of the bending unit induces in the bar itself a bending action which results in bending of the bar on its lengthwise axis upstream of the contrast roller, thus creating problems for the straightness of the bar.

To avoid this shortcoming, the bending unit was then provided with a short displacement movement (a couple of millimetres) towards the arrival of the bar. This movement is suitable to free the contrast roller of the constraint created by the bend in the bar, and therefore the descent of the bending unit becomes possible without detrimental consequences.

According to a variant a small forward axial movement is induced in the bent bar. This movement is enough to release the bend in the bar from the contrast roller, thus enabling the bending disk to be lowered without any detrimental results in the bar.

These movements of the bending unit or of the bar, however, create drawbacks linked to the downtimes in the process, which cause an appreciable slow-down in output.

FR No. 2290969 teaches the installation of a bending unit on a pivoted rocker base with a pivot located downstream of the bending unit, the axis of the unit being normal to the direction of feed of bars. This document teaches a system suitable for application to two-element central cams with the bar passing between them, but the system is not suitable for employment in an embodiment with one central pivot, as is the case of our invention.

To obviate these drawbacks and eliminate the downtimes linked to the reciprocal displacement of the bar and contrast roller, the present applicant has designed, tested and embodied the present invention comprising a bending unit with a contrast roller or equivalent on the axis of the bending disk or plate, a contrast pin or roller being included on the axis of rotation.

The rocker bending unit according to the invention is set forth in the main claim, while the dependent claims describe variants of the idea of the embodiment.

According to the invention the bending unit is caused to rock on a vertical plane passing through or, in any event, parallel to the axis of the bar, the pivot for the rocking movement being located downstream of the bending unit itself and having its axis at a right angle to the axis of the bar.

This conformation has the effect that during rocking the bending unit moves from the bending position to a disengaged position and frees itself independently from the constraint due to the bend in the bar, since it distances the contrast roller momentarily from the bend.

According to the invention the closer the rocker pivot is to the working platform and to the axis of rotation of the bending disk while remaining substantially outside the perimeter of the bending disk, the better the bending unit is able to work.

According to a variant the invention arranges also that the bending unit can move in relation to the working platform on a plane substantially parallel to the working platform in a direction substantially perpendicular to the axis of feed of the bar. The purpose of this is to be able to use any type of contrast roller and bending pin or even to be able to use two analogous or substantially equal contrast rollers, or a contrast roller and bending pin which are differentiated.

According to a variant the bending unit is supported at its periphery, and the contrast element can form part of the bending unit or be stationary and be located outside the bending unit, as in the case of two stationary cams.

The bending unit can be positioned in cooperation with a sheares and be located in cooperation with a drawing assembly, which can be placed upstream or downstream of the bending unit.

Let us now see a preferred non-restrictive example of the invention as illustrated in the attached figures, in which.

Figure 1:
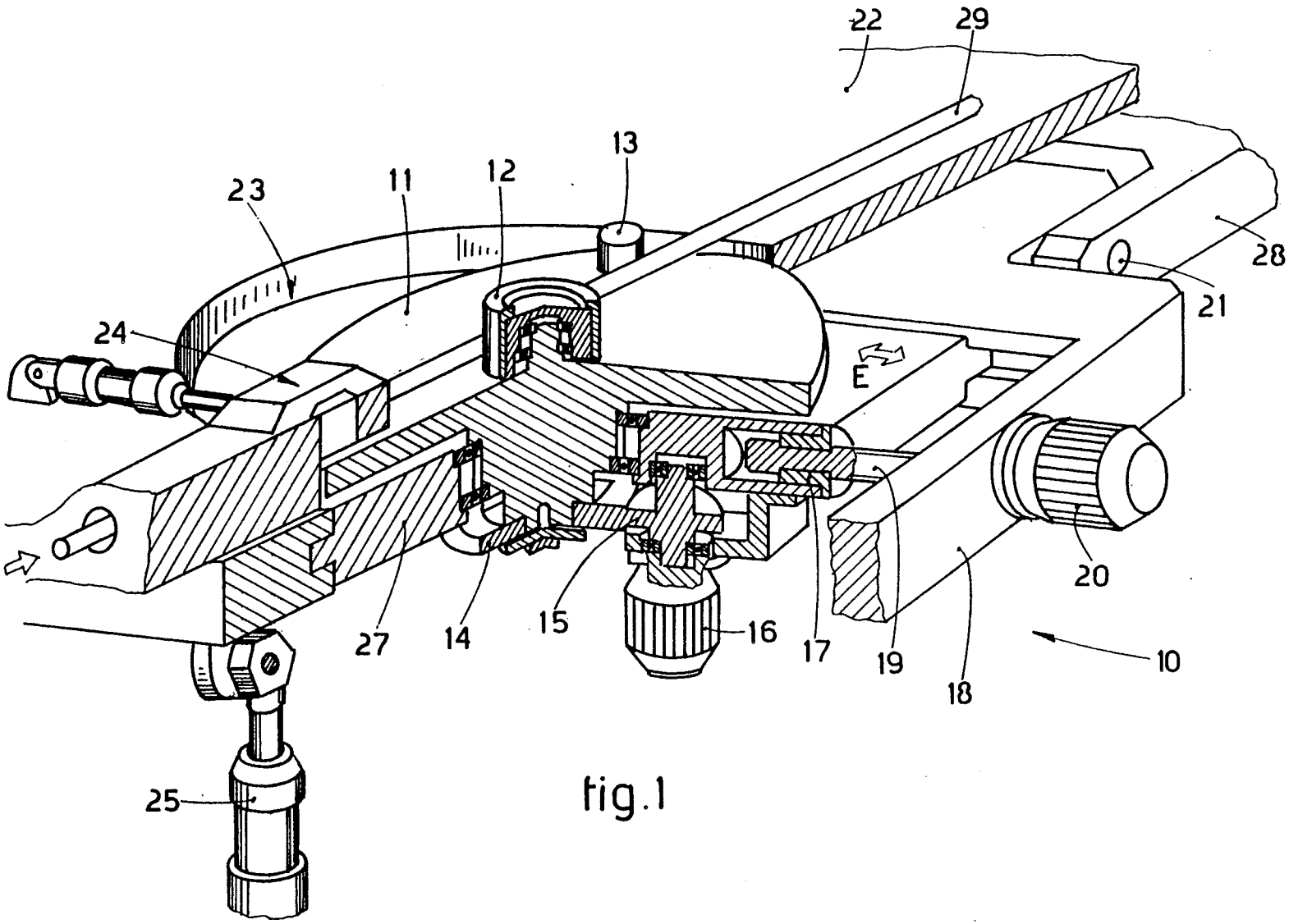
FIG. 1 shows a three-dimensional, partly cutaway diagram of a bending-shaping machine which employs the invention.

In the solution shown as an example of the embodiment of a bending unit 10 a contrast roller 12 can be readily replaced by being moved, as it can be easily adapted thus to the various requirements of a bar 29, and therefore the diameter of the roller 12 can be varied to suit those requirements.

A bending disk 11 in the example shown is set in rotation clockwise (A) or anticlockwise (B) by a driven toothed wheel 14 actuated by a toothed drive wheel 15, which in turn is rotated by a first motor 16.

The first motor 16 can be replaced by any system such as an electric or hydraulic motor, a piston-rack assembly or another system suitable for the purpose, for instance.

The bending disk 11 is located downstream of a shears assembly 24 and is supported on a slider element 27 which can move according to the arrow E on guides within an appropriate seating included in a rocker base 18.

The bending disk 11 can therefore move within an opening 23 located in a working platform 22.

In this example the position of the slider element 27 is controlled by means of a threaded bolt 19 which acts in a threaded sleeve 17 integrally fixed to the slider element 27 itself. The threaded bolt 19 is actuated by a second motor 20.

Any cylinder/piston assembly or other system suitable for quick lateral displacement can be included instead of the second motor 20 and threaded bolt 19.

The rocker base 18 is pivoted on a rocker pivot 21, which has its axis in a position perpendicular to the axis of a bar 29 even though it lies on a different plane below the working platform 22.

The rocker pivot 21 anchors the rocker base 18 to a frame 28 of the machine in such a way that the base 18 can rock, and the frame 28 is stationary in relation to the working platform 22.

In this example the rocking motion according to the arrow C is obtained by means of cylinder/piston rocker assembly 25, which is secured (not shown) to the frame 28 and acts according to the arrow D on the rocker base 18 to produce the desired rocking motion according to the arrow C.

A cam or another means suitable for the purpose can be included instead of the cylinder/piston rocker assembly 25.

Figure 3:
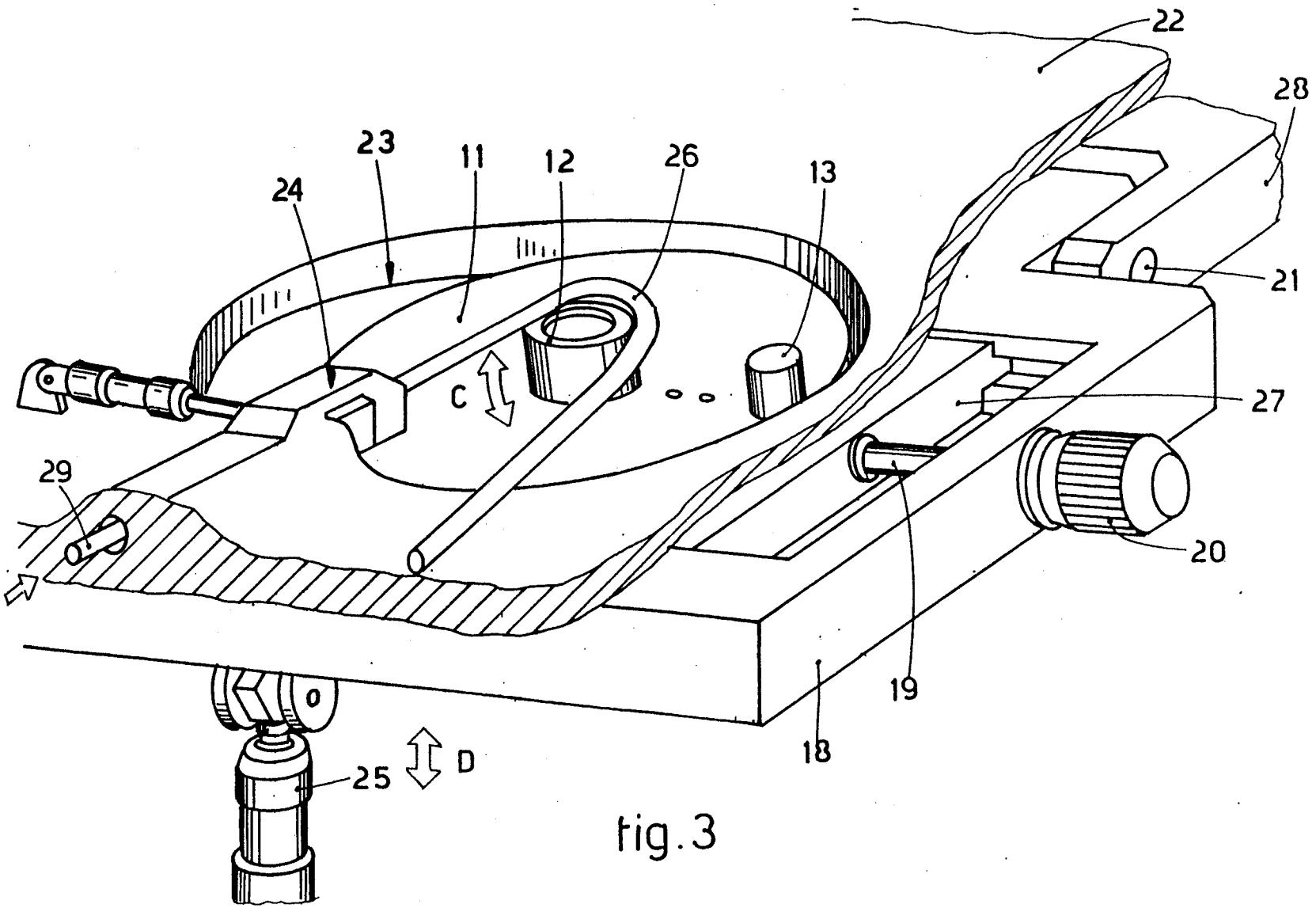
FIG. 3 shows the contrast roller disengaged by the rocking of the bending unit.

Thus, with the invention as shown the bending disk 11 can take up at least two positions, a first higher working position (FIGS. 1 and 4) with its upper surface cooperating with the working platform 22 and a disengaged position (FIG. 3).

In this disengaged position the bending disk 11 and contrast roller 12 are located below the upper generating line of the working platform 22 and therefore the bending disk 11 with its relative contrast roller 12 and bending pin 13 can pass freely according to the arrow E below the bar 29 without touching it.

Figure 2:
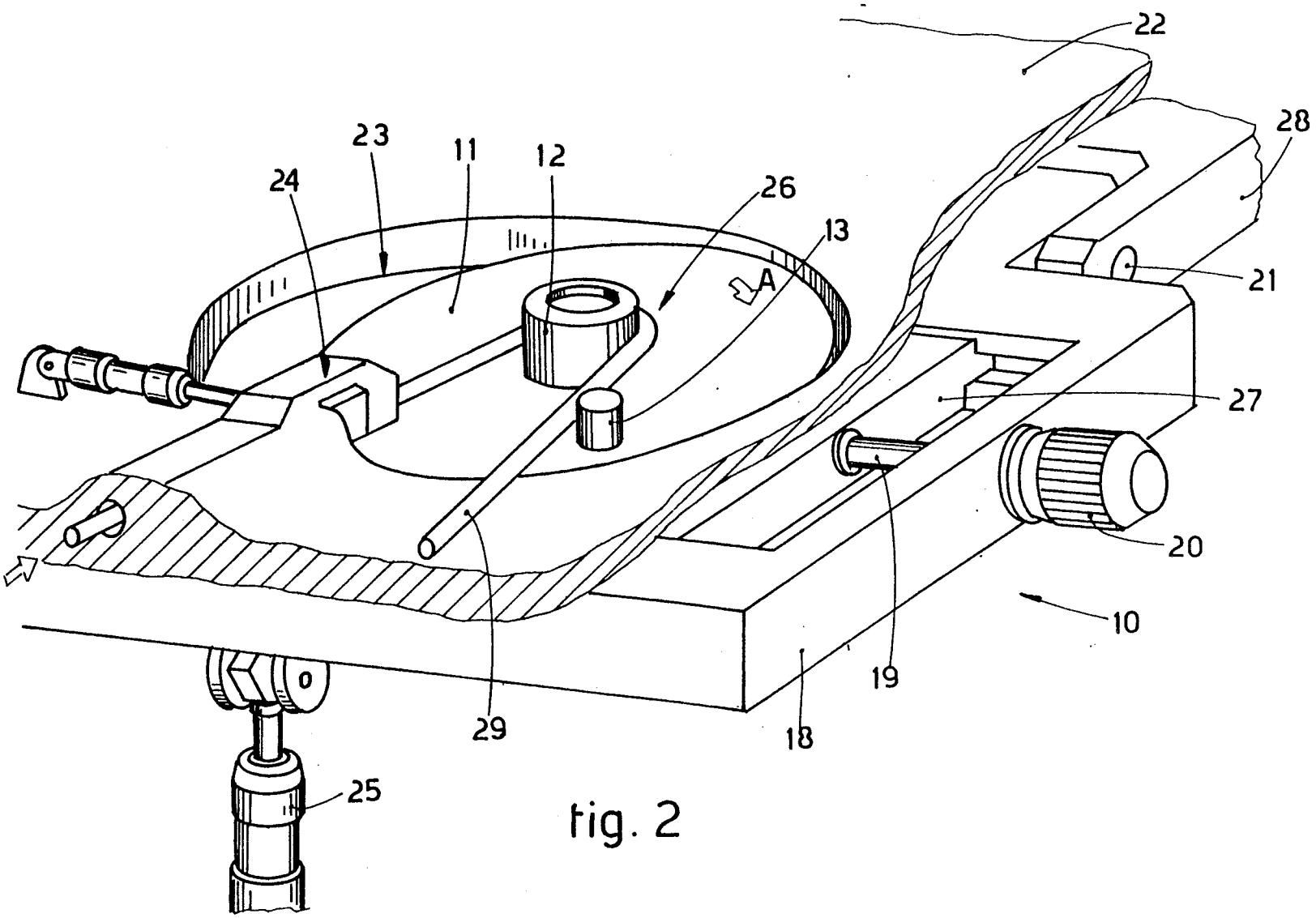
FIG. 2 shows a bend made in a clockwise direction.

As the rocker pivot 21 is positioned downstream of the bending unit 10 and the rocking movement according to the arrow C takes place, for instance, from the position of FIG. 2 to that of FIG. 3, the contrast roller 12, as soon as the rocking action begins, is distanced from the bend 26 in the bar, thus eliminating any contact therewith, so that the contrast roller 12 can descend freely without affecting the bar 29.

Figure 4:
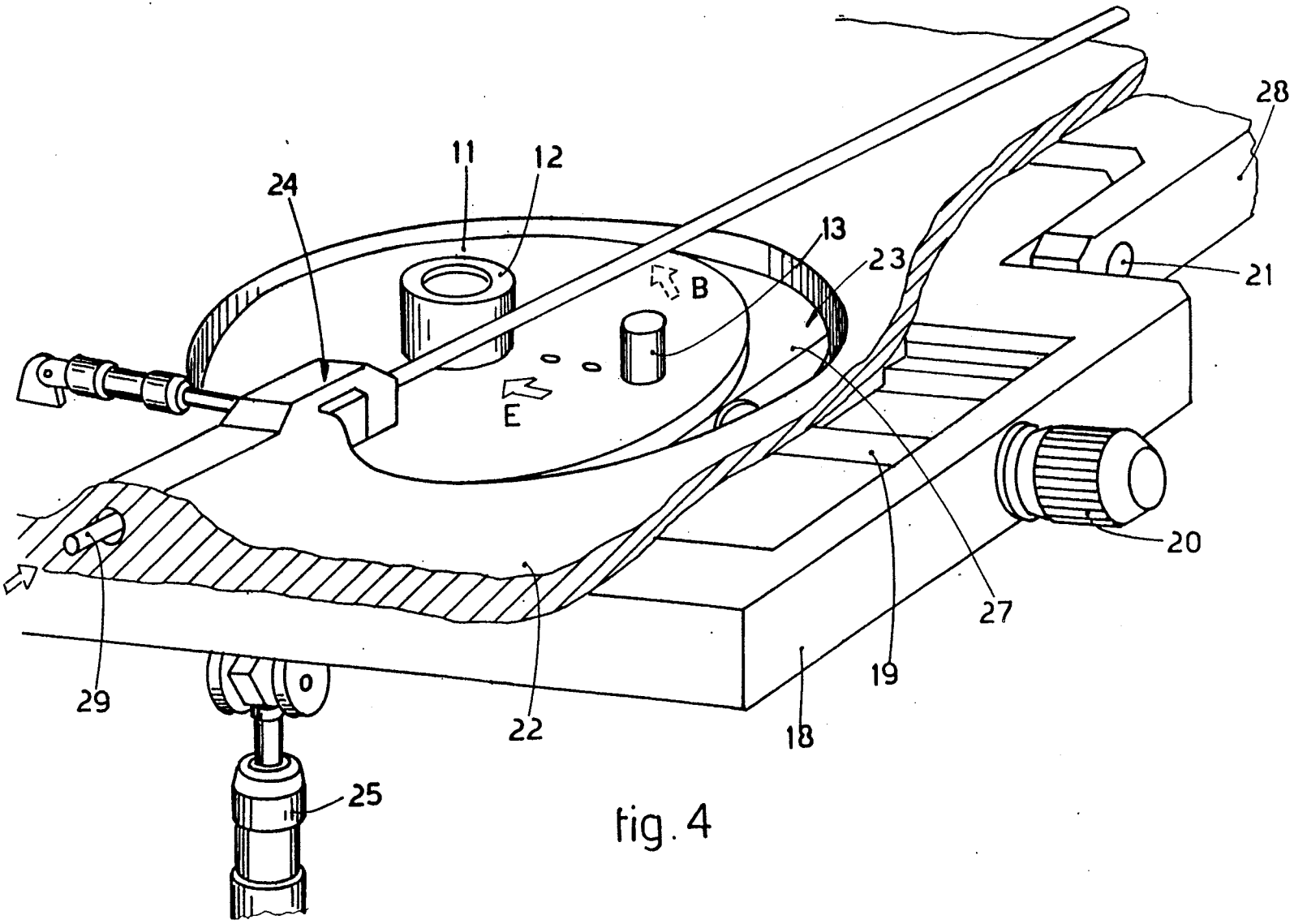
FIG. 4 shows the repositioning of the unit for a bend to be made anticlockwise.

As said above, FIG. 3 shows the bending unit 10 already lowered below the working platform 22, whereas FIG. 4 shows that the bending unit 10 has not only risen again but that during its passage between the position of FIG. 3 and that of FIG. 4 it has also been displaced sideways within the opening 13, thus enabling the contrast roller 12 to move from the righthand side to the lefthand side of the bar 29 and thereby to obtain another type of bend, which would otherwise not have been possible if the contrast roller 12 had stayed on the righthand side of the bar 29.

As said above, a cylinder/piston assembly for swift positioning can be included instead of the second motor 20 and threaded bolt 19.

According to the invention the closer the rocker pivot 21 is positioned to the working platform 22 and to the edge of the bending disk 11, the better the invention functions.

The bending unit 10 according to the invention can process one or more bars 29 at one and the same time.

We claim:

1. A rocker bending unit of a type retractable below a surface of a working platform of a bending-shaping machine for bars and being operably connected to a frame of said bending-shaping machine, wherein said bars are fed through said bending-shaping machine in a longitudinally extending feed direction, comprising:

a base having one end at a downstream side with respect to said feed direction secured to said frame of said bending-shaping machine by a rocker pivot, said rocker pivot having an axis substantially parallel to said surface of said working platform in the geometric neighborhood thereof and perpendicular to said longitudinally extending feed direction;

a slider slidably supported on said base such that said slide is able to move with respect to said base in a direction perpendicular to said longitudinally extending feed direction; and a bending disk fitted on said slider and having an upper major surface extending in a plane parallel to said axis of said rocker pivot, said bending disk being rotatable clockwise and counterclockwise about an axis of rotation perpendicular to said upper major surface, and being provided with a bending pin on its upper major surface positioned out of alignment with said axis of rotation and with a contrast roller or pin coaxial with said axis of rotation.

2. A rocker bending unit according to claim 1, wherein said contrast roller or pin is removably connected to said bending disk.

3. A rocker bending unit according to claim 1, further comprising a drawing unit, said drawing unit being located downstream of said bending disk with respect to said feed direction.

4. A rocker bending unit according to claim 1, wherein said rocker pivot is located below said surface of said working platform.

5. A rocker bending unit as claimed in claim 1, in which the axis of the rocker pivot is in the geometric neighborhood of a peripheral edge of the bending disk.

* * * * *